US009032643B2

(12) United States Patent
Yen

(10) Patent No.: US 9,032,643 B2
(45) Date of Patent: May 19, 2015

(54) ELASTIC STRAP SANDAL

(71) Applicant: Agnes H Yen, Arcadia, CA (US)

(72) Inventor: Agnes H Yen, Arcadia, CA (US)

( * ) Notice: Subject to any disclaimer, the term of this patent is extended or adjusted under 35 U.S.C. 154(b) by 278 days.

(21) Appl. No.: 13/845,018

(22) Filed: Mar. 17, 2013

(65) Prior Publication Data

US 2014/0259738 A1 Sep. 18, 2014

(51) Int. Cl.
*A43B 3/12* (2006.01)

(52) U.S. Cl.
CPC ..... *A43B 3/122* (2013.01); *A43B 3/126* (2013.01)

(58) Field of Classification Search
CPC ..... A43B 3/12; A43B 3/122; A43B 3/126; A43B 3/128
USPC ..... 36/11.5, 51; 12/142 S
See application file for complete search history.

(56) References Cited

U.S. PATENT DOCUMENTS

| | | | | | |
|---|---|---|---|---|---|
| 1,884,301 | A * | 10/1932 | Shaft | 36/11.5 |
| 2,352,098 | A * | 6/1944 | Hess | 36/11.5 |
| 3,063,166 | A * | 11/1962 | Blavier | 36/11.5 |
| 3,228,124 | A * | 1/1966 | Schwarz | 36/11.5 |
| 3,455,037 | A * | 7/1969 | Vlas et al. | 36/11.5 |
| 3,474,477 | A * | 10/1969 | London et al. | 12/142 S |
| 4,200,997 | A * | 5/1980 | Scheinhaus et al. | 36/11.5 |
| 4,333,247 | A * | 6/1982 | Marinelli | 36/11.5 |
| 4,843,736 | A * | 7/1989 | Courian | 36/11.5 |
| 5,247,741 | A * | 9/1993 | Pastor | 36/11.5 |
| 7,103,993 | B2 | 9/2006 | Sakai | |
| 7,231,728 | B2 | 6/2007 | Darby | |
| 7,614,167 | B2 | 11/2009 | Klavano | |
| 8,539,695 | B1 * | 9/2013 | Gemmen | 36/11.5 |
| 2007/0175065 | A1 * | 8/2007 | McDonald | 36/11.5 |
| 2008/0168682 | A1 | 7/2008 | Le | |
| 2014/0259738 | A1 * | 9/2014 | Yen | 36/11.5 |

FOREIGN PATENT DOCUMENTS

| | | | |
|---|---|---|---|
| EP | 1306023 | A2 | 5/2003 |

* cited by examiner

*Primary Examiner* — Marie Bays
(74) *Attorney, Agent, or Firm* — Denis Khoo

(57) ABSTRACT

A sandal comprising an EVA midsole, an outsole and an elastic strap, wherein the elastic strap is stitched at the strap ends and blued to the bottom of the EVA midsole. The EVA midsole having a carved out section to accommodate the thickness of the elastic strap and stitching of the strap ends such that the elastic strap and stitching will lay flush against the bottom of the EVA midsole.

16 Claims, 7 Drawing Sheets

ELASTIC STRAP SANDAL

BACKGROUND OF THE INVENTION

1. Field of the Invention

This invention relates generally to footwear, and more particularly, to a sandal with elastic straps.

2. Description of the Related Art

Sandals have improved through the years with enhancements in comfort, performance, and safety. To enhance comfort, various cushioning materials are used for the insole of the sandals. One popular material is EVA as it is a very good shock absorber and very lightweight. The outsole of the sandal is generally made of a durable material, such as polyurethane. Some sandals, and most shoes will have an outsole, midsole, and insole. The outsole comes in contact with the ground, and the insole is in contact with the wearer's feet. The midsole may be a shock absorbing material, such as EVA, with the insole possibly being a woven fabric. The insole, if not present, will mean that the wearer's foot will come directly into contact with the midsole. It's also possible for some sandals to have a single sole, which may be referred to as the outsole. In this case, the outsole comes in contact with both the ground and with the wearer's feet. An example of a sandal with just an outsole is a clog that is made of a wooden outsole. The outsole, midsole, and insole are each generally comprised of a single layer and material, but it's possible for each of these to have multiple layers in themselves, and comprised of multiple materials.

For sandals with EVA insoles, the straps are usually made of leather, cloth, or plastic straps. With the typical thong sandal, the straps generally go through pre-punched openings in the EVA sole and are held in place via plugs. A plug at the end of the strap is basically larger than the opening of the pre-punched hole, preventing the end of the strap from going through the pre-punched hole. The typical thong sandal has straps that enter the sole through three pre-punched openings, one at the front, and two near the rear. The use of pre-punched holes can result in a less reliable hold of the straps to the sole. With some sandals, rather than using pre-punched holes, the straps may be held in place by folding the ends of the straps under the insole and gluing it.

Plastic straps may be too stiff and uncomfortable for some wearers. In addition, based on the positioning of the plastic straps, they may provide discomfort to the wearer's feet. With plastic, leather or cloth straps, the opening provided by the straps are fixed, and can result in being too tight or loose for the wearer.

During running and walking, pronation and supination normally occur in the foot. Many shoes and sandals can improve a person's gait, and it is normally desirable for the shoes or sandals to not adversely alter a person's gait. It is therefore important for the sole of the sandals to be positioned properly with each step. The fixed opening of a plastic and leather strap may cause it to be too loose for the wearer, and possibly cause the wearer's feet to improperly land on the sandal's sole.

It is desirable to have an open sandal that is comfortable and safe. For comfort, it is desirable to have a good shock absorbing material in the sole, and for safety, it is desirable that the sandals properly hold the feet in place relative to the sole.

BRIEF SUMMARY OF THE INVENTION

A sandal with an EVA sole and elastic strap is described herein. In some embodiments, the sole is comprised of an EVA midsole and an outsole. The elastic strap has strap ends that are stitched together to form a tighter bond when securing to the sole of the sandal. The elastic strap wraps around the bottom of the EVA midsole, and sits flush against the bottom of the EVA midsole due to a carve out of the bottom of the EVA midsole to accommodate the thickness of the elastic strap. The elastic strap is glued to the EVA midsole, and the outsole is glued to the EVA midsole.

BRIEF DESCRIPTION OF THE DRAWINGS

A more complete appreciation of the invention and many of the advantages thereof will be readily obtained as the same becomes better understood by reference to the detailed description when considered in connection with the accompanying drawings, wherein.

DETAILED DESCRIPTION

Figure 1:
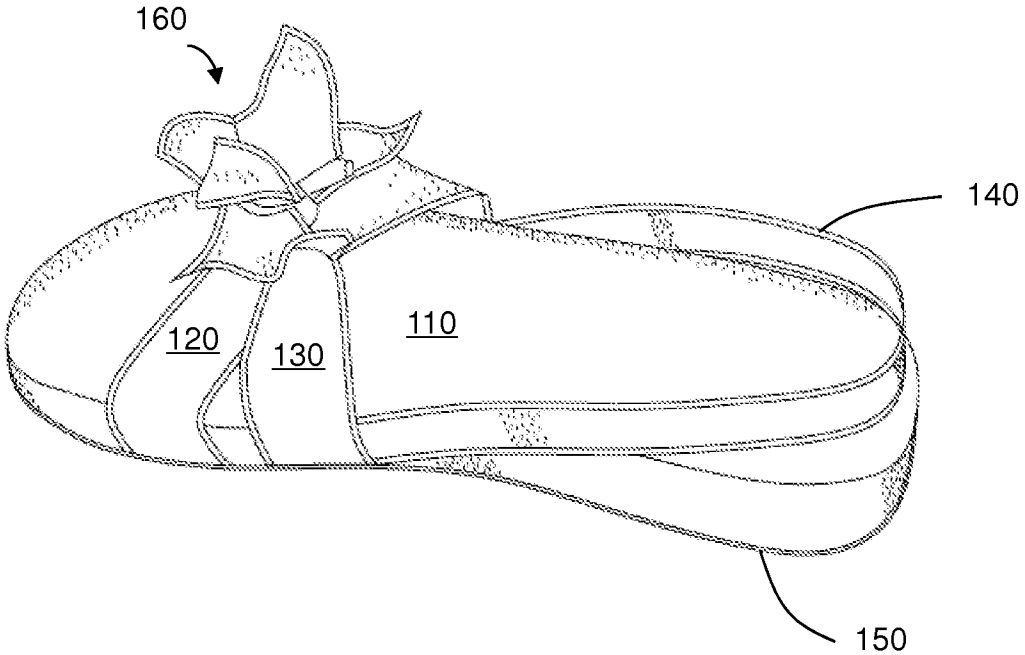
FIG. 1 is a perspective view of an embodiment of an elastic strap sandal.
Figure 2:
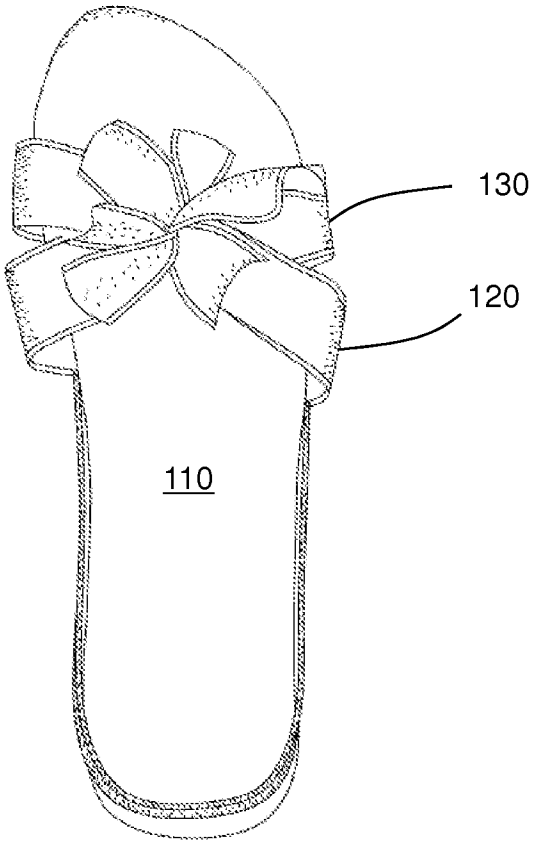
FIG. 2 is a top view of an embodiment of an elastic strap sandal.
Figure 3:
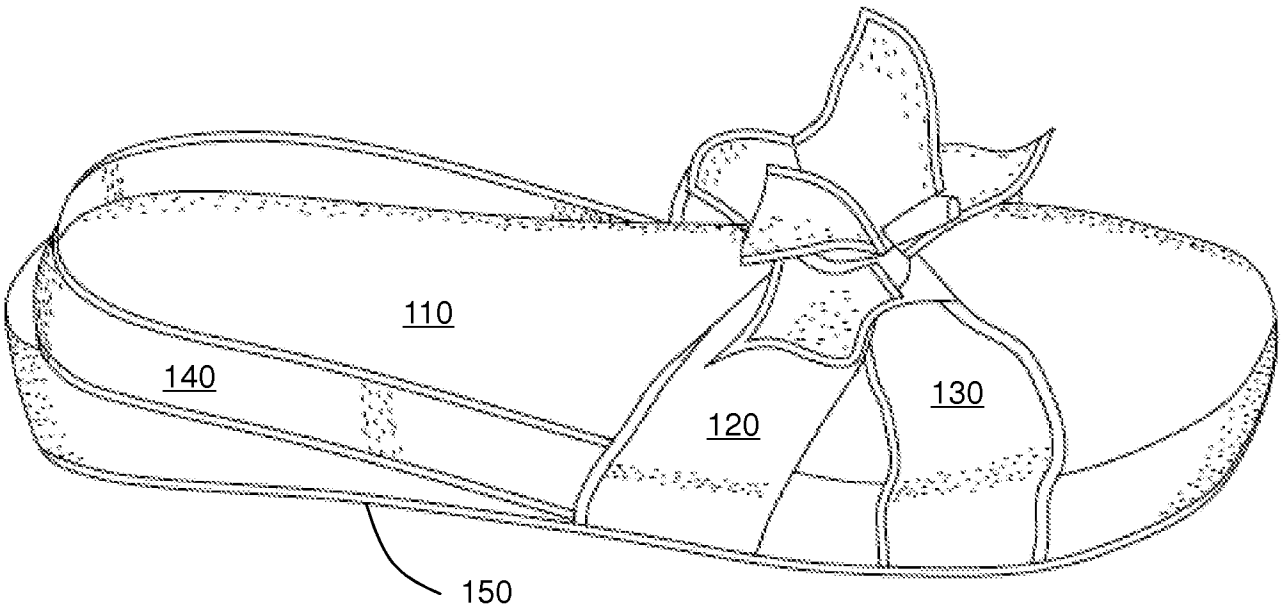
FIG. 3 is a perspective view of an embodiment of an elastic strap sandal.
Figure 4:
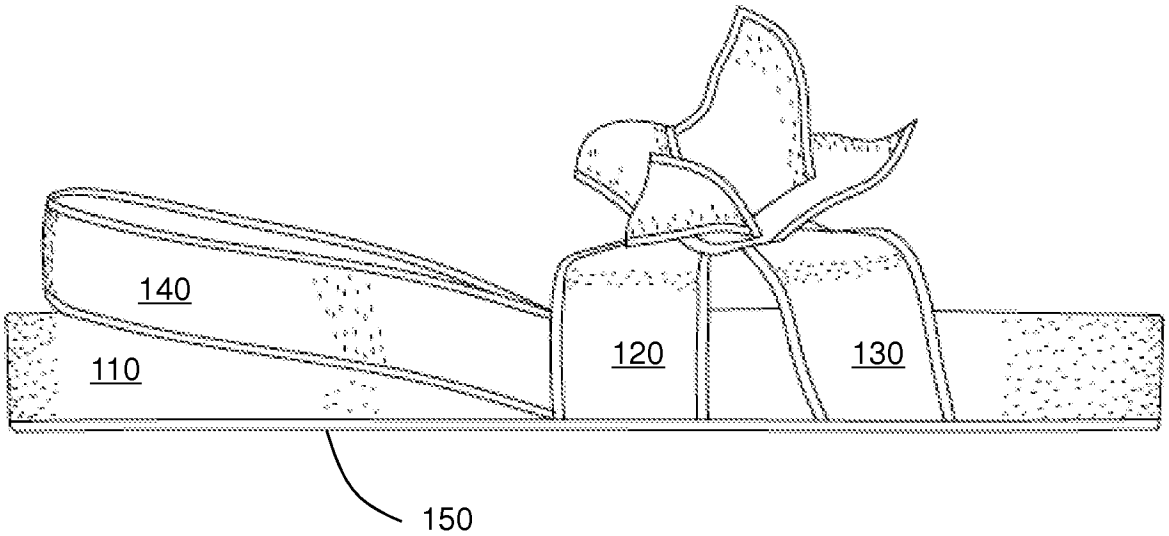
FIG. 4 is a right elevation view of an embodiment of an elastic strap sandal.
Figure 5:
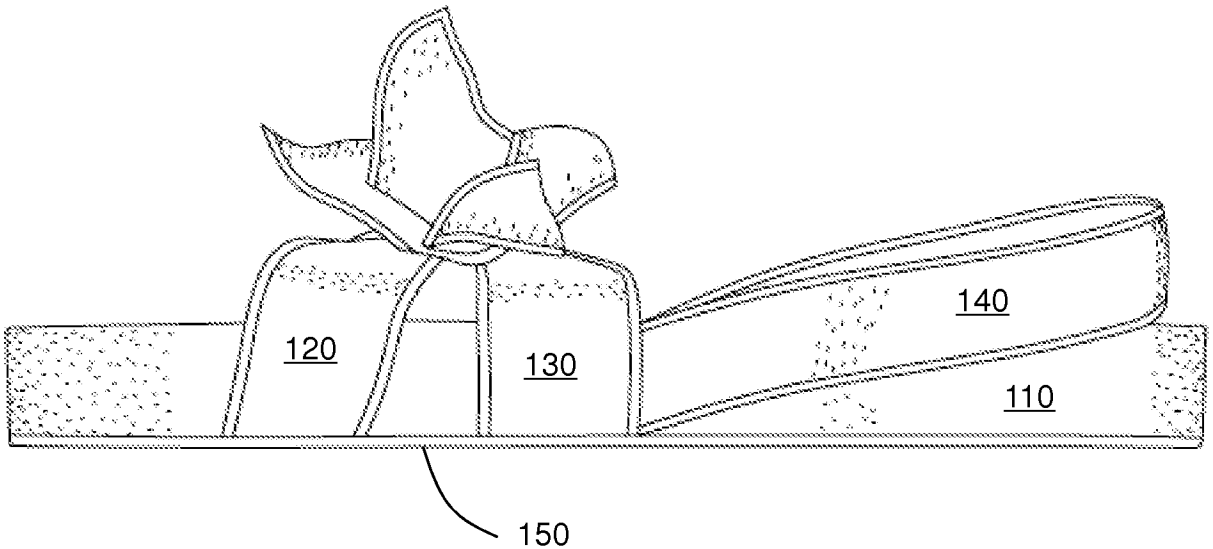
FIG. 5 is a left elevation view of an embodiment of an elastic strap sandal.
Figure 6:
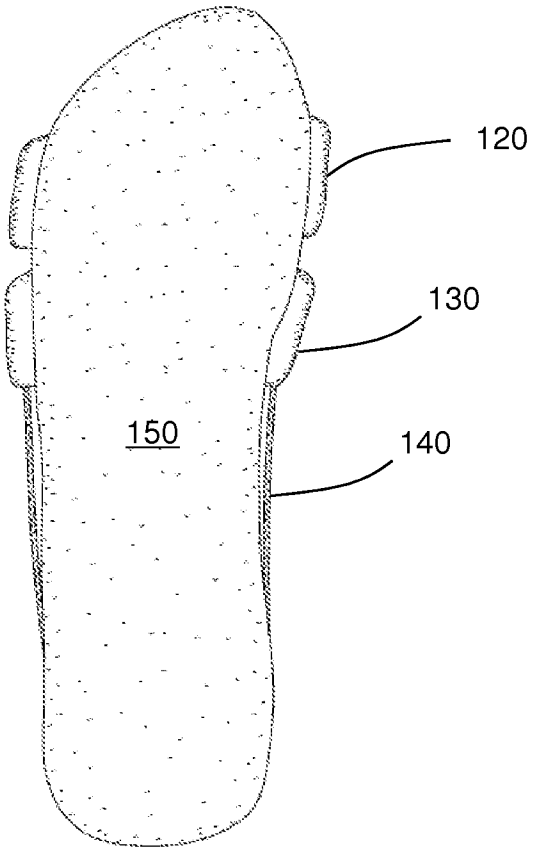
FIG. 6 is a bottom view of an embodiment of an elastic strap sandal.

FIGS. 1-6 shows a preferred embodiment of a sandal with elastic straps. In the preferred embodiment, the dorsal straps 120 130 cross at the top, there is a decorative skirt pattern 160 where the straps cross, and there is a strap for the heel 140. The decorative skirt pattern 160 is for aesthetics and does not contribute to the functionality of the sandals. In other embodiments, there may be other forms of decoration other than the decorative skirt pattern, or there may be no decoration. Other embodiments may not have a heel strap 140.

The dorsal straps 120 130 are crossed in the preferred embodiment, and in other embodiments, the dorsal straps may not cross. The dorsal straps go over the dorsum or top of the foot. In yet other embodiments, there may be a single dorsal strap or a varying number of dorsal straps. The dorsal straps may form a straight line or may form other shapes when going from one side of the sandal to the other side.

In the preferred embodiment, there is an outsole 150 and midsole 110. The outsole 150 is comprised of polyurethane. The midsole 110 is comprised of an EVA material. It is preferred to use an EVA hardness that is shore hardness C 60 or lower. EVA hardness of shore hardness C 40 is utilized in the preferred embodiment. It is difficult to glue plastic or cloth onto an EVA material, and so it is common to find plastic and cloth straps using pre-punched holes to attach to the sole. Leather straps can glue better onto EVA materials, and it so it is common to find leather straps that wrap around the EVA midsole and are glued to sole.

The dorsal straps 120 130 on the preferred embodiment are comprised of a woven elastic material that has a 40% stretch. An elastic strap that has at least 10% stretch is preferred, and other embodiments may have varying degrees of stretch. The heel strap 140 may also be an elastic strap. The elastic material is commonly made up of interwoven strands of rubber or an imitative synthetic fiber. Elastic straps are utilized due to their increased comfort and ability to better shape to the foot. The elastic nature also results in the foot being better held to the sandal.

The dorsal straps 120 130 wrap around the EVA midsole and are glued to the midsole. They may be glued at the side of the EVA midsole and/or the bottom of the EVA midsole. In the preferred embodiment, the glue utilized is a brand called "Nango Resin" manufactured by Nanhai Nanguang Chemical & Package Co. This glue is comprised of toluene, ketone, ester, resin, and synthetic rubber. Elastic straps generally do not glue very well to EVA material, and as such, it may be insufficient to use only glue to hold the elastic strap to the sole of the sandal.

Figure 7:
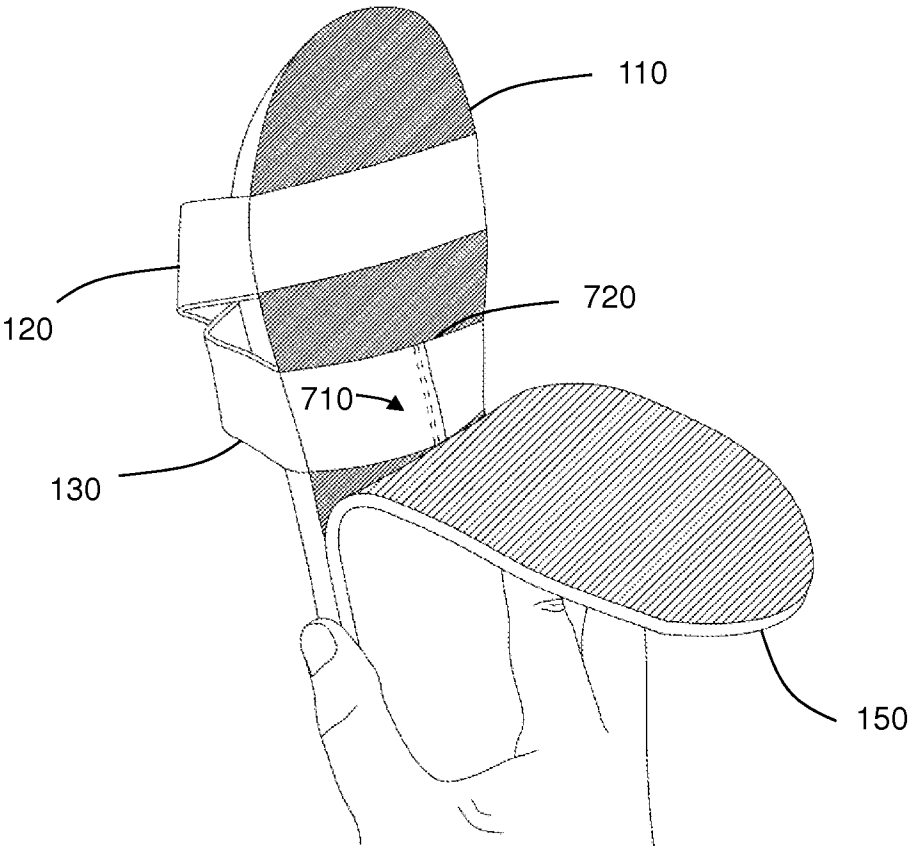
FIG. 7 is a bottom perspective view of an elastic strap sandal with the outsole peeled back.

FIG. 7 shows the sandal of the preferred embodiment with the outsole 150 peeled back to better demonstrate how the dorsal straps 120 130 are attached to the midsole 110 and outsole 150. The dorsal straps 120 130 wrap around the midsole, and the two dorsal straps 120 130 are formed from a single strap that is stitched together at the strap ends 710. In other embodiments, the dorsal straps may be comprised of multiple straps, resulting in more than one pair of strap ends that may be stitched together. Stitching the strap ends together significantly enhances the hold of the strap 120 130 to the midsole over using glue alone.

The midsole 110 has a portion carved out from the bottom in order to accommodate the thickness of the strap 120 130, and allow the strap 120 130 lay flush 720 with the midsole 110 bottom. The stitch point 710 may have a larger thickness, due to the stitching, than the rest of the elastic strap. The carve out of the midsole 110 accommodates this as well by forming a deeper carve out for this stitch point 710. This prevents any protrusions from forming, thus allowing the outsole 150 to appear completely flat when it is glued to the midsole 110 and straps 120 130. Ensuring that the sole of the sandal is flat at the top and bottom of the sole is important in ensuring comfort and proper balance when walking.

The straps ends may also be stitched on the top side of the midsole 110. For example, in FIG. 1, the dorsal straps 120 130 may have strap ends that are stitched together at the top of the midsole 110 while forming a decorative pattern 160 with the strap ends also. The decorative pattern 160 serves to embellish the sandal as well as hide the stitching from direct view.

Although the present invention has been described in detail with respect to certain embodiments and examples, variations and modifications exist which are within the scope of the present invention as defined in the following claims.

What is claimed is:

1. A sandal comprising:

an outsole;

a midsole comprised of an EVA material; and an elastic strap wherein said elastic strap has strap ends that are stitched together, and said elastic strap wraps around the dorsum of the wearer's foot and is held to the sandal by wrapping around the bottom of said midsole about a carved out section of said midsole to accommodate the thickness of said elastic strap and stitching such that said elastic strap lies flush against the bottom of said midsole.

2. The sandal of claim 1 wherein said elastic strap has a stretch of at least 10%.

3. The sandal of claim 2 wherein said EVA material has a shore hardness C 60 or lower.

4. The sandal of claim 3 wherein said outsole is comprised of polyurethane.

5. The sandal of claim 4 wherein said elastic strap is comprised of a plurality of elastic straps and a plurality of strap end stitching.

6. The sandal of claim 5 wherein said plurality of elastic straps is comprised of at least two elastic straps that cross at the top side of said midsole.

7. The sandal of claim 6 further comprising of an elastic heel strap.

8. A sandal comprising:

an outsole;

a midsole comprised of an EVA material; and an elastic strap wherein said elastic strap has strap ends that are stitched together at the top side of said midsole, and said elastic strap wraps around the dorsum of the wearer's foot and is held to the sandal by wrapping around the bottom of said midsole about a carved out section of said midsole to accommodate the thickness of said elastic strap.

9. The sandal of claim 8 wherein said elastic strap has a stretch of at least 10%.

10. The sandal of claim 9 wherein said EVA material has a shore hardness C 60 or lower.

11. The sandal of claim 10 wherein said outsole is comprised of polyurethane.

12. The sandal of claim 11 wherein said elastic strap is comprised of a plurality of elastic straps and a plurality of strap end stitching.

13. The sandal of claim 12 wherein said plurality of elastic straps is comprised of at least two elastic straps that cross at the top side of said midsole.

14. The sandal of claim 11 wherein said strap ends form a decorative pattern to hide the stitching from direct view.

15. The sandal of claim 13 wherein said strap ends form a decorative pattern to hide the stitching from direct view.

16. The sandal of claim 15 further comprising of an elastic heel strap.

* * * * *